US007185455B2

(12) United States Patent
Zaderey

(10) Patent No.: US 7,185,455 B2
(45) Date of Patent: Mar. 6, 2007

(54) CROSSHAIR AND CIRCLE RETICLE FOR PROJECTILE WEAPON AIMING DEVICE

(75) Inventor: Sergey Yury Zaderey, Portland, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 11/271,155

(22) Filed: Nov. 10, 2005

(65) Prior Publication Data

US 2006/0236586 A1 Oct. 26, 2006

Related U.S. Application Data

(63) Continuation of application No. 29/226,654, filed on Mar. 30, 2005.

(60) Provisional application No. 60/626,987, filed on Nov. 10, 2004.

(51) Int. Cl.
*F41G 1/38* (2006.01)

(52) U.S. Cl. ..... 42/122

(58) Field of Classification Search ..... 42/122
See application file for complete search history.

(56) References Cited

U.S. PATENT DOCUMENTS

| | | | | |
|---|---|---|---|---|
| 2,171,571 | A | 9/1939 | Karnes | |
| 2,464,521 | A | 3/1949 | McCall | |
| 3,381,380 | A | 5/1968 | Thomas | |
| 3,392,450 | A | 7/1968 | Herter et al. | |
| 3,470,616 | A | 10/1969 | Thompson | |
| 3,540,256 | A | 11/1970 | Thompson | |
| 6,032,374 | A * | 3/2000 | Sammut | 42/122 |
| D456,057 | S | 4/2002 | Smith | |
| 2004/0016168 | A1 * | 1/2004 | Thomas et al. | 42/122 |
| 2005/0021282 | A1 * | 1/2005 | Sammut et al. | 702/150 |

OTHER PUBLICATIONS

Schmidt & Bender GmbH, "Rifle Scopes Built for the Demanding Needs of the Precision Sharpshooter," 3 pgs (date unknown).
Shepherd Scope Ltd., Shepherd's Easy One Shot Zero, product brochure, 2 pgs (date unknown).
German text on riflescopes: "Zusammenstellung Moglicher Zielfernrohr-absehen", p. 477 (date unknown).
Redfield Optics, LE-9 Sniper Reticle, Jul. 19, 1994, 1 page.

* cited by examiner

*Primary Examiner*—Michael J. Carone
*Assistant Examiner*—Gabriel J. Klein
(74) *Attorney, Agent, or Firm*—Stoel Rives LLP

(57) ABSTRACT

A reticle for a projectile weapon aiming device, such as a riflescope, includes a primary horizontal sight line that intersects a primary vertical sight line to define a primary aiming point. A circle is centered on the primary aiming point to intersect the primary horizontal and vertical sight lines. Multiple aiming marks are preferably spaced apart along the primary horizontal and vertical sight lines and cooperate with the circle and the sight lines to form horizontal and vertical scales for estimating a range to a target having features of known or estimable size. The scales also facilitate windage and holdover aiming adjustments. The circle may facilitate quick target acquisition in rapid fire engagements, as well as enhance range estimation capabilities.

13 Claims, 5 Drawing Sheets

100 METERS

400 METERS

200 METERS

200 METERS

800 METERS

400 METERS

CROSSHAIR AND CIRCLE RETICLE FOR PROJECTILE WEAPON AIMING DEVICE

RELATED APPLICATION

This application claims the benefit under 35 U.S.C. § 119(e) of U.S. Provisional Patent Application No. 60/626,987, filed Nov. 10, 2004, which is incorporated herein by reference. This application is also a continuation of and claims priority under 35 U.S.C. § 120 from U.S. Design patent application Ser. No. 29/226,654, filed Mar. 30, 2005, which is also incorporated herein by reference.

COPYRIGHT NOTICE

©2004 Leupold & Stevens, Inc. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR § 1.71(d).

TECHNICAL FIELD

This application relates to projectile weapon aiming systems such as riflescopes, to reticle configurations for projectile weapon aiming systems, and to associated methods of compensating for ballistic characteristics.

DETAILED DESCRIPTION

Throughout the specification, reference to "one embodiment," "an embodiment," or "some embodiments" means that a particular described feature, structure, or characteristic is included in at least one embodiment. Thus appearances of the phrases "in one embodiment," "in an embodiment," or "in some embodiments" in various places throughout this specification are not necessarily all referring to the same embodiment.

Furthermore, the described features, structures, characteristics, and methods may be combined in any suitable manner in one or more embodiments. Those skilled in the art will recognize that the various embodiments can be practiced without one or more of the specific details or with other methods, components, materials, etc. In other instances, well-known structures, materials, or operations are not shown or not described in detail to avoid obscuring aspects of the embodiments.

Figure 1:
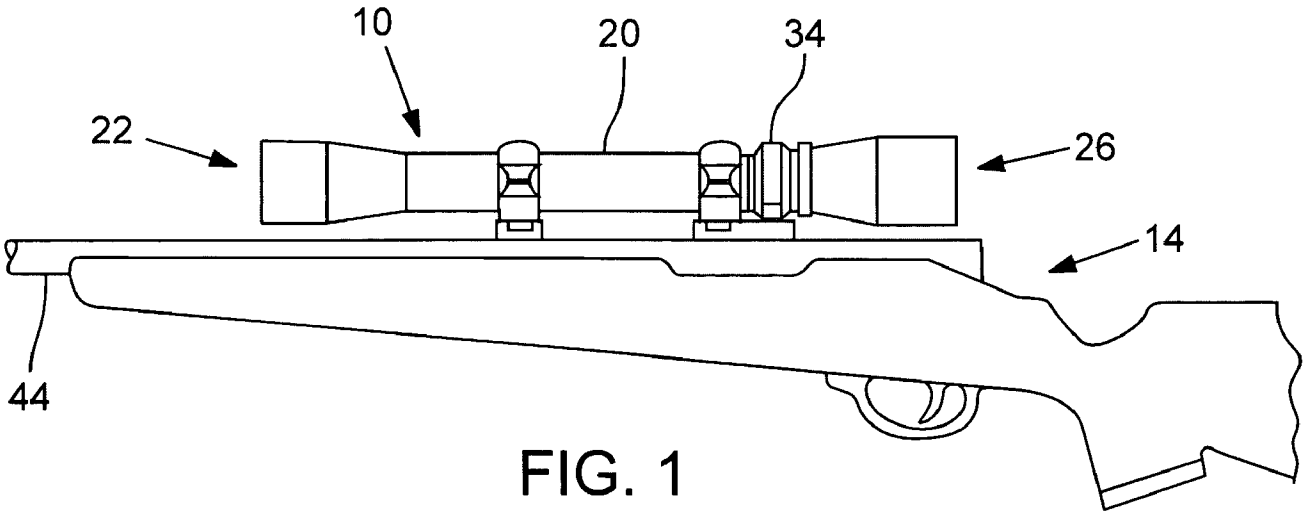
FIG. 1 is a side elevation view of a riflescope mounted on a rifle illustrating an environment of use for reticles shown in FIGS. 3–10.
Figure 2:
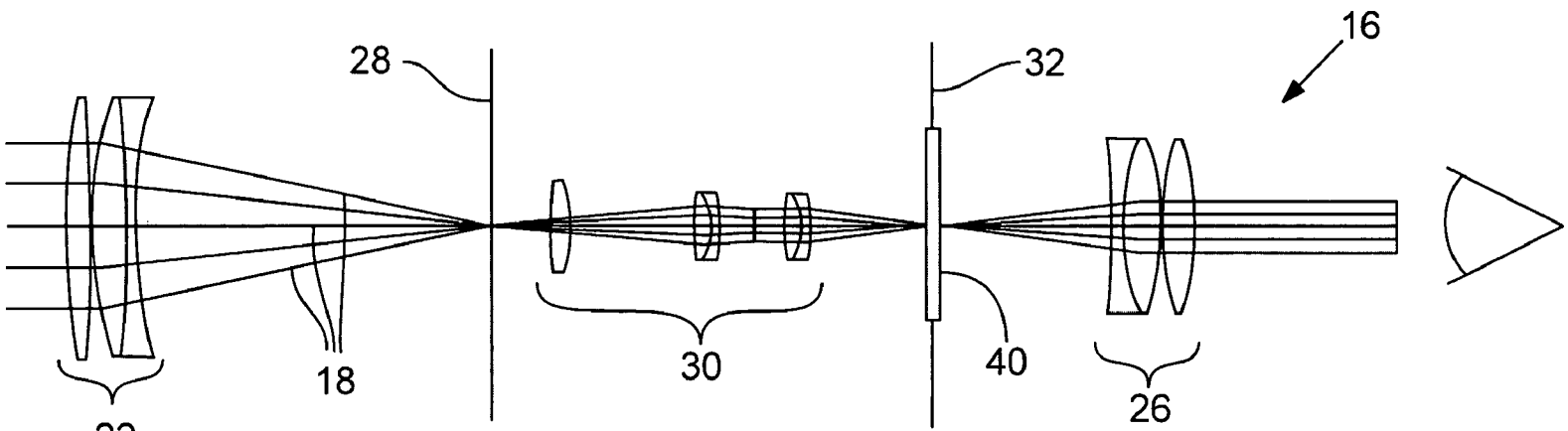
FIG. 2 is a schematic diagram showing optical elements of the riflescope of FIG. 1.

FIG. 1 is a side elevation view of a riflescope 10 mounted to a rifle 14 illustrating an environment of use for reticles (FIGS. 3–10) according to the present disclosure. FIG. 2 is a schematic diagram showing an arrangement of optical elements 16 of riflescope 10, together with ray trace lines 18 indicating the path of light from an observed object (not shown) located to the left of the assembly of optical elements 16, as the light travels through the optical system along an optical path. With reference to FIGS. 1 and 2, riflescope 10 includes a tubular housing 20 that supports at opposite ends an objective or objective lens assembly 22 and an ocular or ocular lens assembly 26 (sometimes referred to as an eyepiece or eyepiece lens assembly). Objective 22 focuses the image of an observed object at a first (front) focal plane 28 located medially of objective 22 and ocular 26. An erector lens assembly 30 interposed between objective 22 and ocular 26 inverts the image and refocuses it at a second (rear) focal plane 32 between erector lens assembly 30 and ocular 26. At least a part of erector lens assembly 30 may be movable in response to rotation of a power selector ring 34 or other power selector mechanism to adjust the optical power of riflescope 10 within a predetermined range of magnification. For example, the optical power of riflescope 10 may range between approximately 8.5× and 25× magnification, in accordance with a first embodiment, or between approximately 6.5× and 20× magnification, in accordance with a second embodiment. Other embodiments may allow optical power adjustment within different ranges of adjustment, such as 4.5–14×, 3.5–10×, and 2.5–8×, for example, the optical zoom ratio in each instance being approximately 3:1. In yet other embodiments, the optical power of riflescope 10 may be fixed or may have a different zoom ratio.

A reticle 40 is located in the optical path between objective 22 and ocular 26 and more preferably between erector lens assembly 30 and ocular 26, at or adjacent second focal plane 32. By way of example, reticle 40 may be used in a riflescope 10 in any of a variety of configurations, including those sold by Leupold & Stevens, Inc., Beaverton, Oregon, USA under the trademarks LPS®, VARI-X®, VX®, MARK 4® and others. However, the reticles described herein are not limited to use in riflescopes or with rifles, but may also be used in various other types of optical sighting devices and projectile weapon aiming devices and may be used to aim one or more of a variety of projectile weapons, such as rifles, pistols, crossbows, artillery, and others.

Figure 3:
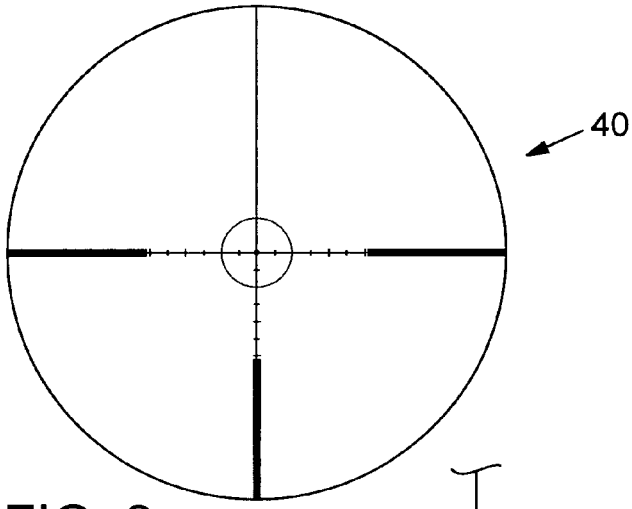
FIG. 3 is a view of a reticle in accordance with a preferred embodiment as viewed through an ocular (eyepiece) of a riflescope.
Figure 4:
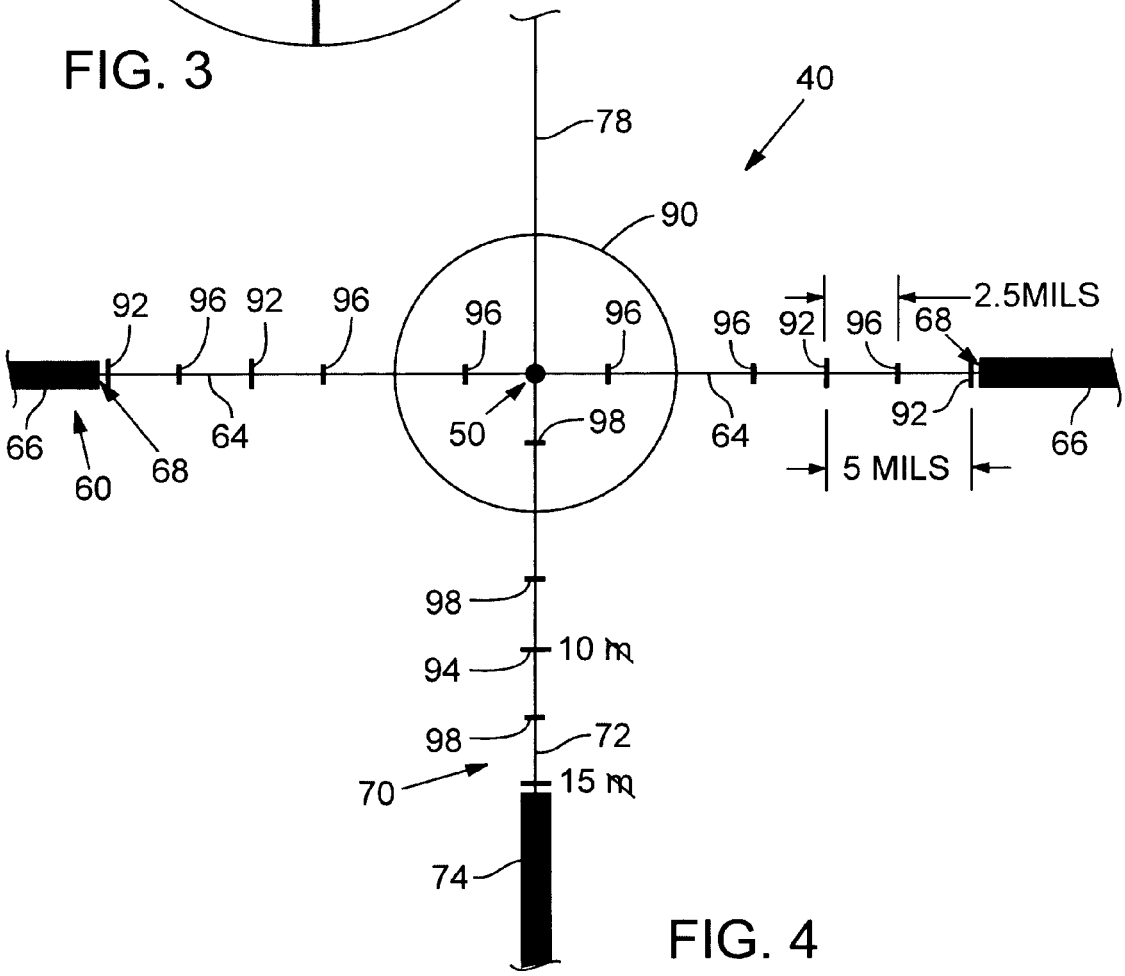
FIG. 4 is an enlarged view of the reticle of FIG. 3, with dimensions noted.

FIG. 3 is a pictorial representation of an embodiment of reticle 40 as viewed through ocular 26 of riflescope 10. FIG. 4 is an enlarged pictorial representation of a central region of the reticle 40 of FIG. 3. With reference to FIGS. 3 and 4, reticle 40 is preferably formed on a substantially flat disc of optical quality material, such as glass or plastic, and includes a primary aiming point 50 defined by the intersection of a primary horizontal sight line 60 and a primary vertical sight line 70 (crosshairs). While primary sight lines 60, 70 and other indicia, described below, may be marked on the surface of a transparent reticle disc of a riflescope, they may also be embodied in other forms, such as illuminated reticle devices, projected targeting displays, head-up displays, simulated reticle images, and the like. Thus, the terms "reticle", "mark", "marking", "marks", "lines", and the like are not limited to permanent inscriptions on a physical object, but are intended to also include all kinds of visually perceptible patterns, signs, and symbols, regardless of the way in which they are created and regardless of whether their elements are permanent or transitory in nature, or a combination of both permanent and transitory elements.

Referring specifically to FIG. 4, the primary horizontal sight line 60 includes central portions 64 that extend radially from primary aiming point 50. The primary aiming point 50 is preferably emphasized by a solid center dot, which may improve visibility and enhance range estimation and hold-over aiming capabilities of reticle 40, as described below. However, in other embodiments (not shown), the primary aiming point may be represented by the intersection of the primary horizontal sight line 60 with the primary vertical sight line 70 without the solid dot; by primary horizontal and vertical sight lines 60, 70 having a small aperture at the center (not shown) approximately the same width as the lines themselves (forming an open square area at the hypothetical intersection point); or by other aiming points or features. For example, one open aperture configuration is shown in FIGS. 2 and 3 of U.S. Design patent application Ser. No. 29/226,654, which is incorporated herein by reference. The term "intersection" is used herein in the context of the arrangement of the primary horizontal and vertical sight lines 60, 70 to describe the place at which they cross or converge, regardless of whether they actually touch at the place where they converge. Thus, the terms "intersect", "intersection" and the like, should be construed to include lines that approach each other in a transverse arrangement, whether or not they include gaps at the place where their axes intersect.

The primary horizontal sight line 60 further includes two widened post portions 66 that extend radially from the corresponding thin central portions 64. Post portions 66 may be one and a half times thicker than central portions 64 and may be three or more times thicker, to draw a shooter's eye to the thinner central portions 64 and thereby help the shooter to locate primary aiming point 50. In some embodiments, innermost ends 68 of widened post portions 66 may serve as reference points for leading compensation.

The primary vertical sight line includes a lower central portion 72 that extends radially downward from the primary aiming point 50 and a vertical post portion 74 that extends radially from the lower central portion 72. The vertical post portion 74 may be at least one and a half times thicker than the lower central portion 72, and, in some embodiments, may be three or more times thicker than lower central post portion 72. The primary vertical sight line 70 may optionally further include an upper portion 78 extending radially from the primary aiming point. The upper portion 78 may have a thickness approximately equal to that of the lower central portion 72. The reticle 40 further includes a circle 90 that intersects the horizontal central portions 64, vertical upper portion 78, and vertical lower central portion 72. The primary aiming point 50 defines the center of the circle 90. The reticle 40, thus, includes superimposed crosshair and circle-dot patterns. The resulting reticle may have particular applicability in combat, while maintaining a simple and efficient appearance that is fast to use. The crosshairs 60, 70 and other features of reticle 40 enable an operator to lead moving targets and compensate for ballistic drop. The circle-dot pattern can be employed for quick acquisition in close quarter battle under rapid fire conditions. All or part of the reticle 40 may be illuminated for improving reticle visibility in low-light conditions.

The reticle 40 includes right and left secondary horizontal aiming marks 92 disposed on the central portions 64 of the primary horizontal sight line 60. The secondary horizontal aiming marks 92 are spaced to provide range estimation and compensate for wind effect and to lead a moving target. The distances between the circle 90 and the primary aiming mark 50 and between the circle 90 and the closest secondary horizontal aiming marks 92 are approximately equivalent. The circle 90 may be used for both ranging and aiming compensation. The reticle 40 further includes a secondary vertical aiming mark 94 disposed on vertical lower central portion 74. The secondary vertical aiming mark 94 is approximately spaced the same distance from the circle as the secondary horizontal aiming marks 92. The secondary aiming marks 92, 94 have a thickness that is approximately equivalent to or less than their respective central portions 64, 72 and are finer than the circular, oval, or football shapes of conventional mil-dots. Finer marks afford greater target visibility and more accurate shot placement. Accordingly, the secondary aiming marks 92, 94 are less likely than mil-dots to obscure targets at long ranges and may improve shooting accuracy.

The reticle 40 may further include horizontal and vertical tertiary aiming marks 96 and 98, respectively, disposed on horizontal central portions 64 and vertical lower central portion 72. The tertiary marks 96, 98 subdivide the space between the secondary aiming marks 92, 94 into equal halves. Accordingly, a single tertiary aiming mark 96, 98 is disposed equidistant between two adjacent secondary aiming marks 92, 94. The tertiary marks 96, 98 further subdivide the distance between the circle 90 and the primary aiming point 50. As with the secondary aiming marks 92, 94, the tertiary aiming marks 96, 98 have a thickness that is approximately equal to or less than the respective central portions 64, 72. The tertiary aiming marks 96, 98 may have a length less than the secondary aiming marks 92, 94 to indicate the measure of a lesser unit value.

In the depicted embodiment, the diameter of the circle subtends 10.0 milliradians (mils) and the diameter of the primary aiming point subtends 0.30 mils at the highest optical power setting of the riflescope 10. The secondary aiming marks and circle 40 provide a scale of 5.0 mils and the tertiary aiming marks provide further scale divisions of 2.5 mils. As skilled persons will appreciate, a milliradian is a unit of measure for angles subtended by reticle features that correspond to different horizontal and vertical distances at different ranges. For example, the subtension of 1 mil equals 3.6 inches at 100 yards or 36 inches at 1,000 yards. In metric units, 1 mil corresponds to 10 centimeters at 100 meters or 1 meter at 1,000 meters. Knowing the particular subtension and the estimated size of the target (or a reference object near the target) allows the distance to the target to be estimated with considerable accuracy.

Figure 5:
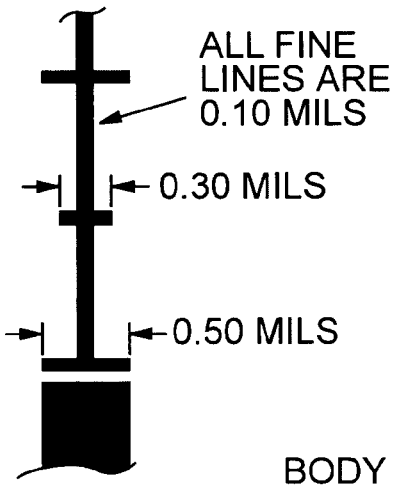
FIG. 5 is an enlarged view of a portion of the reticle of FIG. 4, with dimensions noted.

Referring to FIG. 5, an expanded view of a portion of the reticle 40 is shown to illustrate dimensions. The lengths of the secondary and tertiary marks 92, 94, 96, 98 and the thickness of the post portions 66, 74 and central portions 64, 72 also offer reference dimensions in convenient milliradian increments. In one embodiment, the post portions 66, 74 may have a thickness of 0.5 mils and the central portions 64, 72 may have a thickness of 0.1 mils. The length of the secondary marks 92, 94 may be 0.5 mils and the length of the tertiary marks 96, 98 may be 0.3 mils. Such lengths are one example of a configuration to facilitate mark and subdivision recognition. The reticle offers direct mil scales in 0.1, 0.3, 0.5, 2.5, 5.0, 7.5, 10.0, 12.5, 15.0, 17.5, 20.0, 22.5, 25.0, 27.5, and 30.0 mils. As persons skilled in using conventional mil-dot reticles will appreciate, the marks and scales of reticle 40 can be visually subdivided and/or combined by a trained operator to produce a wide range and variety of reference combinations for target ranging as well as leading and holdover compensation. Although milliradians (mils) have been referenced herein, alternative units may be used, such as minute of angle (MOA) wherein 1 MOA=1/60th degree. The physical thickness of the marks (as distinguished from their observed subtension) is sized appropriately to the magnification of the optical sight with which the reticle 40 is designed to be used. In operation, the scales provided by the reticle 40 may be subdivided and/or combined by a trained operator to produce reference combinations for target ranging, leading, and holdover precision.

FIGS. 4 and 5 show only a single embodiment. However, numerous variations in the design of reticle 40 may be employed and still be within the scope of the invention. For example, the number and size of secondary and tertiary aiming marks 92, 94, 96, 98 may vary. The secondary and tertiary aiming marks may also indicate alternative units of measure. The primary horizontal and vertical aiming lines 60, 70 may be shaped or tapered, as in a Leupold CPC™ reticle. And many other features and shapes may be included.

Figure 6:
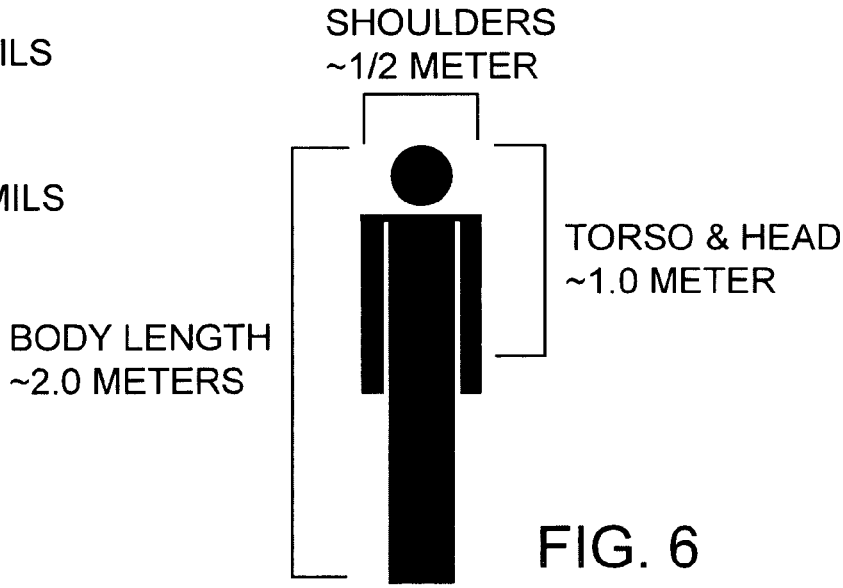
FIG. 6 is a diagram of estimated dimensions of a human target.
Figure 7A:
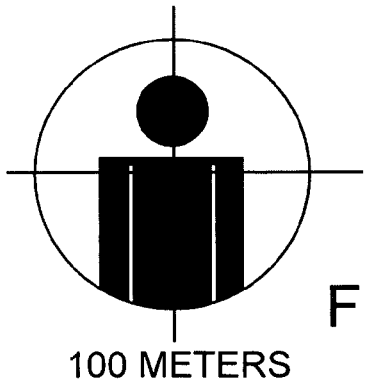
FIGS. 7A–C are views of the reticle of FIGS. 3–5 being used to estimate range based on the shoulder width of the human target.
Figure 7B:
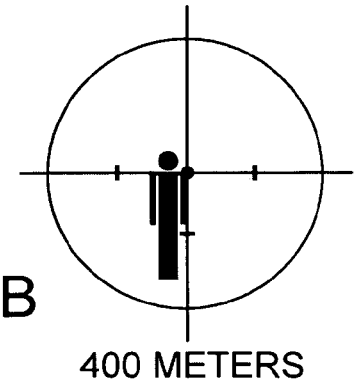
Figure 7C:
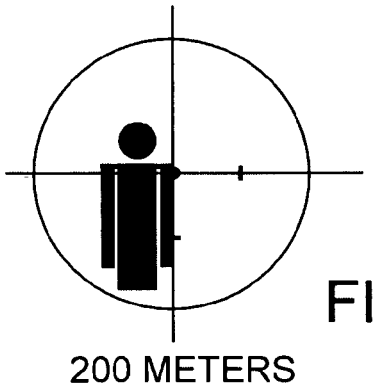
Figure 8A:
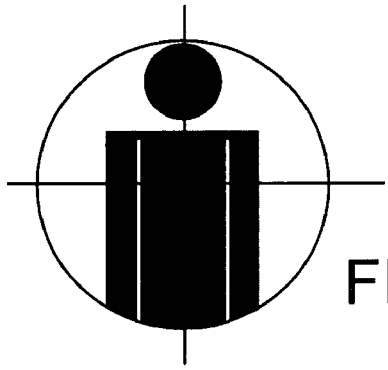
FIGS. 8A–C are views of the reticle of FIGS. 3–5 being used to estimate range based on the torso height of the human target.
Figure 8B:
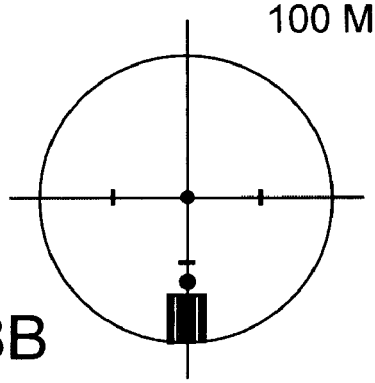
Figure 8C:
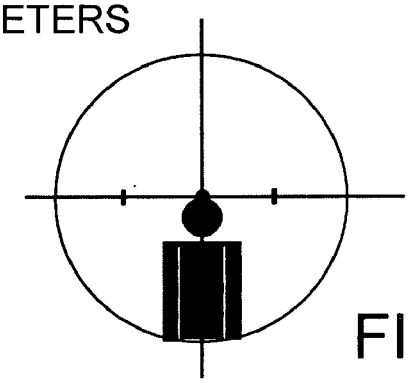
Figure 9A:
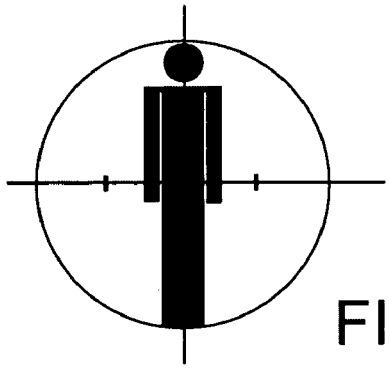
FIGS. 9A–C are views of the reticle of FIGS. 3–5 being used to estimate range based on the body length of the human target.
Figure 9B:
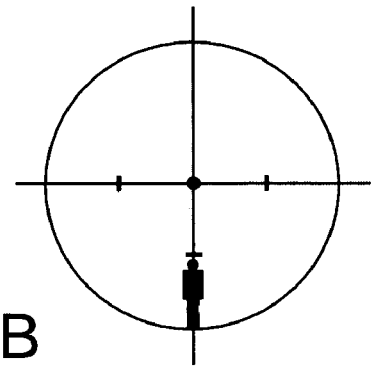
Figure 9C:
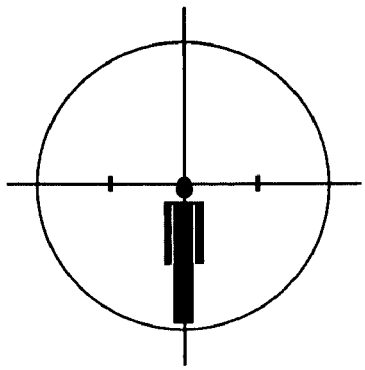
Figure 10:
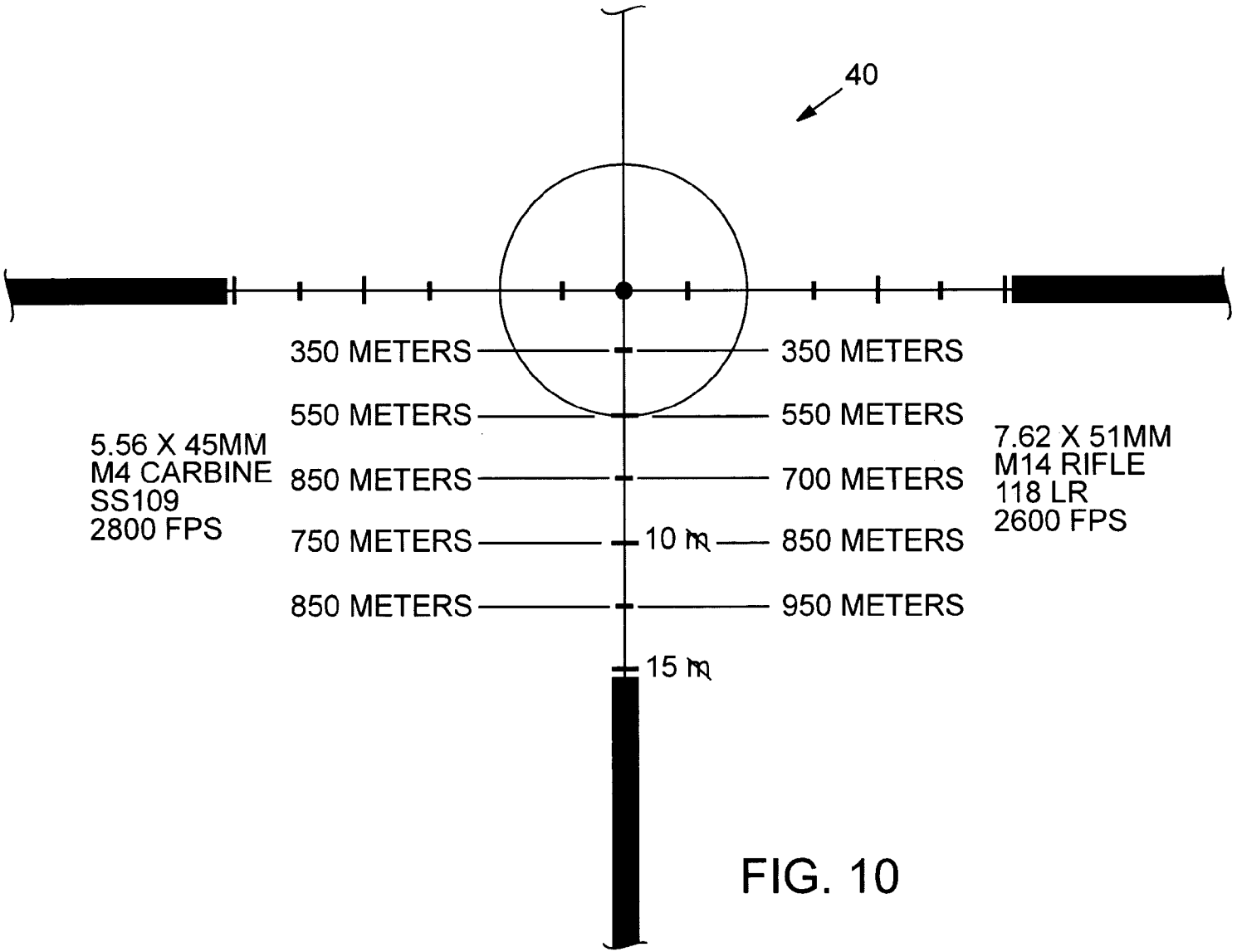
FIG. 10 is a view of a reticle of FIGS. 3 and 4 with indicated ranges at which primary and secondary vertical aiming marks can be used for holdover compensation for two common military rifle and cartridge combinations.

Referring to FIGS. 6–10, operation of reticle 40 will now be described. By way of background, FIG. 6 illustrates a human target with approximate vertical and horizontal dimensions of features of the human target noted. By using features of the human body or other known targets of similar proportions, the operator can estimate the target's range.

Referring to FIGS. 7A–C, 8A–C, and 9A–C views of the reticle of FIGS. 3 and 4 are shown superimposed over the human target of FIG. 6. By aligning the marks and circle of the reticle 40 over target features (such as shoulder width (FIGS. 7A–7C), torso height (FIGS. 8A–8C), and overall height (FIGS. 9A–9C)) having approximately known dimensions, the operator is able to determine a range to the target. Based on the estimated range, the operator may then use the vertical secondary and tertiary aiming marks 94, 98 corresponding to the estimated range for holdover aiming, to compensate for ballistic drop expected at the estimated range. In a similar manner, circle 90 and horizontal marks 92, 96 may be used to make windage adjustments, or to estimate the speed of a moving target and to lead the target accordingly.

To facilitate better holdover aiming accuracy, vertical marks 94, 98 are spaced in increments that correlate to bullet drop at incremental ranges. For example, with reference to FIG. 10, reticle 40 is shown with holdover ranges noted for two different rifle/cartridge combinations commonly used by military personnel. As noted in FIG. 10, the holdover ranges are rounded to the nearest 50 meter increment so that they are relatively easy to remember.

Projectile weapon aiming systems and reticles have been described herein principally with reference to their use with rifles and embodied as riflescopes. However, skilled persons will understand that projectile weapon aiming systems may include aiming devices other than riflescopes, and may be used on weapons other than rifles, which are capable of propelling projectiles along substantially predeterminable trajectories, e.g., handguns, crossbows, and artillery. Thus, it will be obvious to those having skill in the art that many changes may be made to the details of the above-described embodiments without departing from the underlying principles of the invention. The scope of the present invention should, therefore, be determined only by the following claims.

The invention claimed is:

1. A reticle for a projectile weapon aiming system, comprising:

a primary horizontal sight line;

a primary vertical sight line intersecting the primary horizontal sight line to define a primary aiming point;

a circle centered on the primary aiming point, the circle intersecting the primary horizontal sight line to the right and left of the primary aiming point, and the circle intersecting the primary vertical sight line below the primary aiming point;

multiple horizontal aiming marks spaced apart along the primary horizontal sight line, the horizontal aiming marks, the intersections of the circle with the primary horizontal sight line, and the primary vertical sight line cooperating to form a horizontal scale for estimating a range to a target having features of known or estimable horizontal size, the horizontal aiming marks and the circle also being usable as aiming points for windage adjustment and leading of a moving target; and multiple vertical aiming marks spaced apart along the primary vertical sight line, the vertical aiming marks, the intersections of the circle with the vertical sight line, and the primary horizontal sight line cooperating to form a vertical scale for estimating range to a target having features of known or estimable vertical size, the vertical aiming marks and the circle also being usable as aiming points for holdover adjustment at predetermined ranges.

2. The reticle of claim 1, wherein the diameter of the circle subtends 10 mils.

3. The reticle of claim 1, wherein the vertical and horizontal scales are divided in increments of 5 mils.

4. The reticle of claim 1, wherein the vertical and horizontal scales are divided in increments of 2.5 mils.

5. The reticle of claim 1, wherein the primary aiming point comprises a dot.

6. The reticle of claim 5, wherein the dot subtends 0.3 mils.

7. The reticle of claim 1, wherein:

the vertical aiming marks include secondary vertical aiming marks and tertiary vertical aiming marks that are smaller than the secondary vertical aiming marks; and the horizontal aiming marks include secondary horizontal aiming marks and tertiary horizontal aiming marks that are smaller than the secondary horizontal aiming marks.

8. The reticle of claim 1, wherein at least one of the vertical aiming marks and at least two of the horizontal aiming marks is located inside the circle.

9. The reticle of claim 1, wherein one of the vertical aiming marks bisects a segment of the primary vertical sight line extending between the primary aiming point and the intersection of the circle with the primary vertical sight line.

10. The reticle of claim 1, wherein the horizontal aiming marks include marks that bisect a segment of the primary horizontal sight line extending between the primary aiming point and the intersection of the circle with the primary horizontal sight line to the right and left of the primary aiming mark.

11. The reticle of claim 1, wherein:

the primary horizontal sight line includes a horizontal central portion extending radially from the primary aiming point, and a horizontal post portion being at least one and a half times thicker than the horizontal central portion and extending radially from the horizontal central portion; and the primary vertical sight line includes a vertical lower central portion extending radially from the primary aiming point, and a vertical post portion being at least one and a half times thicker than the vertical central portion and extending radially from the vertical lower central portion.

12. A projectile weapon aiming system including the reticle of claim 1.

13. A riflescope including the reticle of claim 1.

* * * * *